US006561496B2

(12) United States Patent
Gliniecki et al.

(10) Patent No.: US 6,561,496 B2
(45) Date of Patent: May 13, 2003

(54) CARBURETOR THROTTLE CONTROL DETENT MECHANISM

(75) Inventors: Gary U. Gliniecki, Ruth, MI (US); Paul S. Learman, Bad Axe, MI (US); George M. Pattullo, Caro, MI (US); David L. Thomas, Cass City, MI (US)

(73) Assignee: Walbro Corporation, Cass City, MI (US)

( * ) Notice: Subject to any disclaimer, the term of this patent is extended or adjusted under 35 U.S.C. 154(b) by 0 days.

(21) Appl. No.: 09/982,062

(22) Filed: Oct. 18, 2001

(65) Prior Publication Data

US 2002/0163088 A1 Nov. 7, 2002

Related U.S. Application Data

(60) Provisional application No. 60/288,829, filed on May 4, 2001.

(51) Int. Cl.[7] ..... F02M 9/08
(52) U.S. Cl. ..... 261/52; 261/65
(58) Field of Search ..... 261/52, 65

(56) References Cited

U.S. PATENT DOCUMENTS

| | | | | | |
|---|---|---|---|---|---|
| 2,867,424 | A | * | 1/1959 | Sutton | 261/52 |
| 2,982,275 | A | * | 5/1961 | Doman et al. | 123/198 DC |
| 3,304,067 | A | * | 2/1967 | Hebert | 261/34.3 |
| 3,669,636 | A | * | 6/1972 | Garretson et al. | 48/180.1 |
| 3,920,777 | A | * | 11/1975 | Harrison et al. | 261/39.3 |
| 4,053,449 | A | * | 10/1977 | Yoshioka et al. | 261/44.3 |
| 4,192,834 | A | * | 3/1980 | Berkbigler | 261/52 |
| 4,631,153 | A | * | 12/1986 | Tamba et al. | 261/52 |
| 5,078,111 | A | * | 1/1992 | McCann | 123/400 |
| 5,215,049 | A | * | 6/1993 | Wolf | 123/179.18 |
| 5,500,159 | A | * | 3/1996 | Martinsson | 261/52 |
| 5,891,369 | A | * | 4/1999 | Tuggle et al. | 261/35 |
| 6,000,683 | A | * | 12/1999 | Van Allen | 261/52 |

FOREIGN PATENT DOCUMENTS

| | | | |
|---|---|---|---|
| JP | 55-35132 | * | 3/1980 |
| JP | 55-128646 | * | 10/1980 |

* cited by examiner

*Primary Examiner*—Richard L. Chiesa
(74) *Attorney, Agent, or Firm*—Reising, Ethington, Barnes, Kisselle, Learman & McCulloch, P.C.

(57) ABSTRACT

A carburetor having a throttle valve co-rotatable with a small diameter throttle shaft having a free end protruding from an exterior side surface of the associated carburetor body. A throttle lever detent arm is co-rotatable on and with the throttle shaft free end adjacent each body surface. Interengageable detents on the detent arm and body surface are spaced radially away from the throttle shaft rotational axis by a distance, for example, of about three times the shaft diameter. The arm and body detents are releasably engageable with one another for thereby yieldably holding the detent arm and hence the throttle shaft and associated throttle valve in any one of a plurality of selected angular settings. Hence, the angular tolerance variation on the set positions of the throttle valve blade as controlled by the detents is now, for example, approximately three times more precise so that the tolerance limits for such positions are now rendered three times tighter than otherwise would be possible when utilizing the prior art. Hence manufacturing tolerances do not need to be tightened up in order to achieve the exemplary three-fold improvement in operational tolerances of the carburetor throttle control detent mechanism. The invention thus provides a low cost throttle control detent mechanism that enables fine increment, positive stops at predetermined valve blade settings, such as the W.O.T. (wide-open throttle), idle and closed valve positions.

14 Claims, 5 Drawing Sheets

CARBURETOR THROTTLE CONTROL DETENT MECHANISM

This is a regular utility U.S. patent application filed pursuant to 35 U.S.C. §111(a) and claiming the benefit under 35 U.S.C. §119 (e) (1) of the priority U.S. provisional patent application Serial No. 60/288,829 filed May 4, 2001.

FIELD OF INVENTION

The present invention relates to throttle control mechanisms of carburetors for internal combustion engines, and more particularly to such a mechanism incorporating a detent mechanism for yieldably holding and positioning the throttle valve in one or more of a predetermined plurality of operational positions.

BACKGROUND OF THE INVENTION

Manually operated throttle valve control levers are typically provided on small carburetors designed for use with low displacement gasoline fueled engines, such as used on chain saws, weed whips, leaf blowers, and other small lawn, garden and forestry portable appliances. Although the throttle valve is typically operator manipulated for angular travel throughout an operable range from closed to wide-open, a throttle control detent mechanism is customarily provided for yieldably holding the throttle valve in a selected one of two or three predetermined operating positions, e.g., namely wide-open throttle (W.O.T.), idle and fully closed. On larger lawn and garden appliances the detent mechanism may be built into the throttle control linkage parts, such as a control knob protruding through a control panel slot having notches along the travel path of the control knob arm. However in very small lawn and garden appliances, such as weed whips and leaf blowers, the engines are typically of small size and of low displacement, and therefore typically are provided with a cubic-type diaphragm carburetor that may only be between one and two inches square in outside dimensions. The throttle control linkage may only consist of a single lever fixed at one end to the throttle shaft and protruding to a finger-grip free end located in an operator-accessible zone adjacent to the carburetor mounting location on the engine.

Heretofore the typical detent mechanism utilized in such small carburetor throttle control mechanisms consists of a conventional ball and spring detent. This type of throttle detent mechanism requires that a blind bore be provided in the carburetor body for receiving the compression coil spring as well as the hardened steel ball that seats against the free-end of the spring. The spring-biased ball rides against the throttle shaft circumference and is forced into whichever one of three throttle shaft pockets comes into registry with the ball during throttle shaft rotation.

Due to the minuscule dimensions of these detent mechanism parts involved in such tiny carburetors, and particularly the very small diametrical dimension of the throttle shaft, it is difficult in the first instance to machine the detent pockets on the throttle shaft, and even more difficult if not economically impossible to angularly locate the pockets to the sufficiently close manufacturing circumferential dimensional tolerances that would be required in order to accurately establish within close angular tolerances the predetermined positive position stops for the throttle valve at W.O.T., idle and closed valve settings.

In addition, there are the usual manufacturing and assembly costs involved in providing the spring and ball type throttle control detent mechanism, and these costs are particularly aggravated when producing very small cubic carburetors of the aforementioned type.

OBJECTS OF THE INVENTION

Accordingly, among the objects of the present invention are to provide an improved carburetor throttle control detent mechanism that eliminates the need for the aforementioned ball and spring type detent mechanism and yet is also built into the carburetor assembly and hence does not require any cooperative construction either on the engine or the appliance on which the engine is installed, that achieves reduced costs of manufacture and assembly and yet is capable of controlling the throttle valve clocking operation in very small and precise increments, and that allows a choice of a plurality of predetermined positive detent stop positions for the throttle valve throughout the range of throttle valve operation from W.O.T. to fully closed.

Another object of the invention is to provide an improved carburetor throttle control detent mechanism of the aforementioned character which, when employed on a carburetor having a choke valve shaft, is capable of utilizing the choke control shaft as one of the cooperative detent stops in the detent control mechanism.

A further object of the present invention is to provide an improved carburetor throttle control detent mechanism of the aforementioned character in which the throttle control lever and the detent cam member of the mechanism are combinable into one unitary piece part in order to further reduce overall cost of manufacture and assembly of the carburetor and associated throttle control mechanism.

SUMMARY OF THE INVENTION

In general, and by way of summary description and not by way of limitation, the invention fulfills one or more of the foregoing objects by providing a carburetor having a body with an air-fuel mixture passageway and a rotatable throttle valve in said passageway mounted for rotation on and with a throttle shaft that is journaled for rotation on a rotational axis in said body. The throttle shaft has a free end protruding exteriorly from an exterior side surface of the body. Typically the throttle shaft has a given diameter of relatively small dimension. A throttle lever detent arm is mounted on the throttle shaft free end for rotation therewith in an angular travel path about the rotational axis and adjacent the body exterior side surface. First detent means are provided on the body side surface located in fixed position adjacent the travel path of the detent arm and spaced radially away from the rotational axis a predetermined distance greater than the diameter of the throttle shaft by a multiple of the shaft diameter dimension, e.g., a distance about three times the shaft diametrical dimension. Second detent means are provided on the detent arm that likewise are generally spaced such predetermined distance radially away from the rotational axis. The detent means are constructed and oriented so as to be releasibly engageable with one another for thereby yieldable holding the detent arm and hence the throttle shaft and associated throttle valve in any one of a plurality of selected angular settings.

One of the primary features of the carburetor throttle control detent mechanism of the invention is providing engagement of the first and second detent means, regardless of their structural form, in an arc of mutual engagement along a detent arm cam travel path having a radial dimension, centered on the throttle shaft rotational axis, that is a multiple of the small diameter dimension of the throttle shaft, such as a multiple of three times the shaft diametrical dimension. This large radius of the travel path of the arcuate cam control surface thus allows the tolerance limits of the radial variations that are spaced circumferentially apart along the cam surface to be manufactured to the same manufacturing tolerance specifications that are otherwise normally employed in machining a detent ball seating groove in the throttle shaft when providing the prior art ball/spring detent mechanism.

Yet in so doing, and without tightening up prior manufacturing tolerance specifications, the angular tolerance variation on the set positions of the throttle valve blade as controlled by the detent cam surface is now approximately three times more precise, i.e. the tolerance limits for the detent controlled predetermined angular positions of the throttle valve are now rendered three times tighter than otherwise would be possible when utilizing the prior control detent pockets provided in the surface of the throttle shaft. Hence manufacturing tolerances do not need to be tightened up in order to achieve a three-fold improvement in operational tolerances of the carburetor throttle control detent mechanism. The invention thus provides a low cost throttle control detent mechanism that enables fine increment, positive stops at predetermined valve blade settings, such as the W.O.T. (wide-opened throttle), idle and closed valve positions.

In one embodiment the throttle lever detent arm comprises a planer segment of a circle with an arcuate cam surface having radial variations therein spaced circumferentially therealong and forming the first detent means, the second detent means comprises a cam follower means fixedly supported on the body side surface and yieldably engaging and tracking on the segment cam surface and registerable with the radial variations therealong for releasibly holding the detent arm segment in any one of the plurality of settings as determined by location of the radial surface variations circumferentially along the segment cam surface. The segment cam surface comprises an arcuate peripheral free edge and the segment is constructed to have void means located adjacent the segment free edge to thereby add resilience to the free edge engagement with the cam follower means tracking therealong and also to thereby reduce the mass of the detent arm segment. Preferably the radial variations of the cam surface comprise indentations spaced circumferentially therealong in predetermined locations corresponding to the plurality of selected angular settings of said throttle valve. The cam follower means preferably comprises a spring biasing pin cantilever mounted in the body side surface and yieldably registerable with the indentations when the same are individually brought into angular alignment with the pin in response to rotation of the throttle shaft.

Preferably one of the indentations is designed to correspond to the closed position of the throttle valve and comprises an inclined surface oriented such that engagement with the cam follower pin develops a torque on the detent arm segment in a direction tending to further close said throttle valve to thereby maintain a closing bias on the throttle valve during such engagement.

In another embodiment one of the radial edge variations of the detent arm segment peripheral edge comprises a concavity, and the carburetor has a rotatable choke shaft with a choke valve mounted on said choke shaft for rotation therewith. The choke shaft has a free end protruding from the carburetor body side surface adjacent the travel path of the segment free edge and oriented to function as one of the second detent means by yieldable registry engagement of the segment edge concavity therewith.

In yet another embodiment the carburetor also has a throttle lever constructed for manual manipulation for swinging through an operational range corresponding to the angular operational range of said throttle valve. The lever is operable to impart operator torque forces on the throttle shaft for rotating the same, and the throttle lever detent arm is integrated with the throttle lever and fixed thereto for co-rotation therewith. The throttle lever and throttle lever detent arm may be integrated into a unitary part so that they are co-planar with one another.

Preferably the lever portion of the unitary part has additional void means radially outwardly of the segment free edge for reducing the overall mass of the part.

In still another embodiment the first detent means on the carburetor comprises at least one pocket concavity formed in the body side surface and the second detent means comprises a lateral projection on the throttle lever detent arm oriented to ride on the body side surface and operably snap into the pocket concavity upon registry therewith by spring bias developed in the throttle lever detent arm. This embodiment provides the additional advantage of using the lateral projection as a replacement for the axially biasing spring typically found on current throttle controls.

In a reversal embodiment the radial variations along the arcuate cam surface of the detent arm comprise radial protrusions spaced circumferentially therealong corresponding to the selected angular settings of the throttle valve. The cam follower means comprises a semi-resilient paddle member having a shallow "W" configuration in radial cross section adapted to slidably bear on the cam surface and to be cammed over and then individually registered with the radial protrusions. The cam follower has a stem portion received in a mounting opening in the side surface of the carburetor body for cantilever support therefrom of the cam follower means.

In a still further embodiment the throttle lever detent arm comprises a pair of angularly spaced apart, radially extending support legs joined at one end to a hub mounted on the throttle shaft free end. The radially outermost distal ends of these support legs carry an arcuate cam track member having the arcuate cam surface thereon and the radial variations formed therein to provide such first detent means.

BRIEF DESCRIPTION OF THE DRAWINGS

The foregoing as well as other objects, features and advantages of the present invention will become apparent from the following detailed description of the best mode, appended claims and accompanying drawings (which are to engineering design scale unless otherwise indicated) in which:

(FIG. 10).

(FIG. 21) position.

DETAILED DESCRIPTION OF THE PREFERRED EMBODIMENTS OF THE INVENTION

Figure 1:
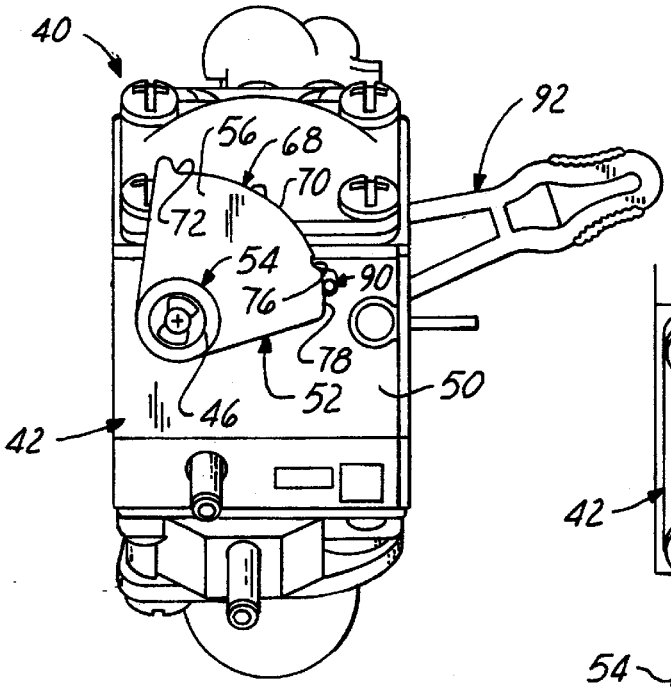
FIGS. 1 and 2 are side elevational and top plan views respectively of a diaphragm type cubic carburetor adapted for use on a small displacement engine such as that utilized for driving a hand-held leaf blower appliance and provided with a first embodiment of a throttle valve control detent mechanism of the invention.

First Embodiment of Carburetor Throttle Control Detent Mechanism

Referring in more detail to the accompanying drawings, FIGS. 1–10 illustrate a first embodiment carburetor throttle control detent mechanism of the invention as provided in conjunction with a conventional diaphragm type cubic carburetor 40 adapted for example, for use on a leaf blower appliance engine. Carburetor 40 has a generally cube-shaped body 42 that may typically measure only approximately one and a half inches (approximately 40 mm.) on each side. Body 42 has an air-fuel mixture through passageway 44 (FIGS. 8–10) and a cylindrical throttle valve shaft 46 journaled in body 42 for rotation about an axis 66 that extends across passageway 44 and carries a butterfly-type throttle valve blade 48 fixed thereon for rotation therewith. Due to the small size of carburetor 40, throttle shaft 46 necessarily has a given outside diameter of relatively small dimension, for example on the order of 3/16 inch (approximately 5 mm).

In accordance with a principal feature of the present invention, carburetor 40 is constructed such that one end of throttle shaft 46 protrudes exteriorly from a side surface 50 of carburetor body 42 and its exposed free end (not shown) is machined to have a non-circular splined configuration (not shown). A first embodiment of the throttle lever detent arm 52 is mounted on the free end of throttle shaft 46 and keyed for rotation therewith, as will be more apparent from the details of construction of detent arm 52 shown in FIGS. 3–7.

Figure 8:
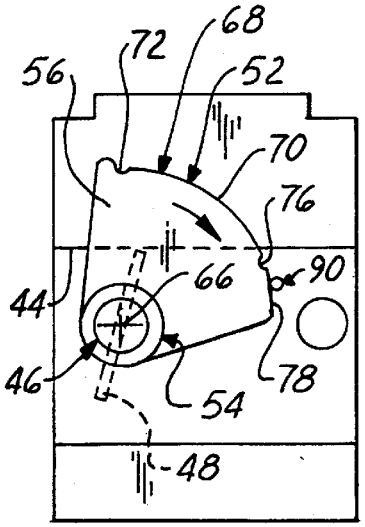
FIGS. 8, 9 and 10 are simplified semi-diagrammatic side elevational views of the carburetor of FIG. 1 respectively illustrating the positions of the throttle lever detent arm and corresponding positions of the associated throttle valve in its closed position (FIG. 8), idle position (FIG. 9) and in wide-open position (W.O.T.)
Figure 9:
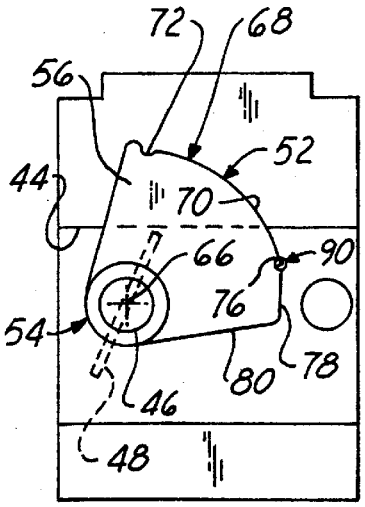
Figure 10:
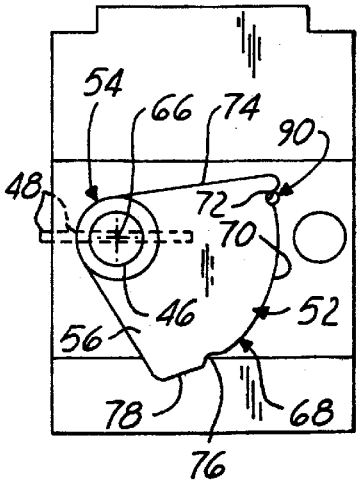
Figure 3:
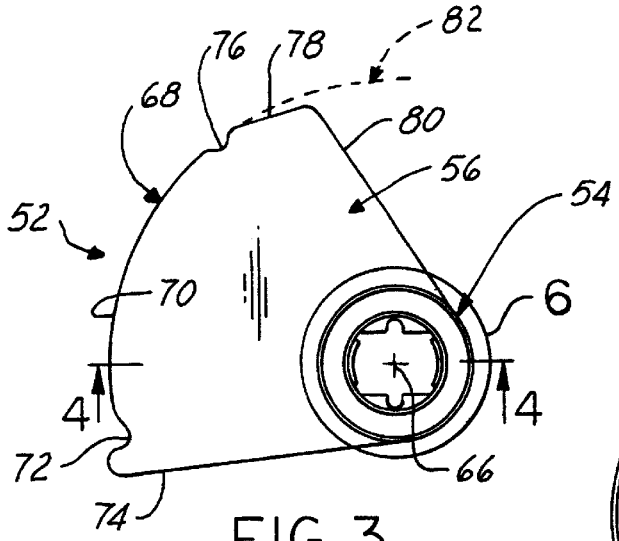
FIG. 3 is a side elevational view of the first embodiment throttle lever detent arm employed on the carburetor of FIGS. 1 and 2 but shown by itself in FIG. 3.
Figure 6:
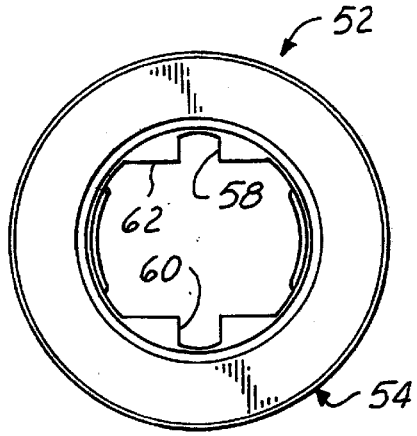
FIG. 6 is an enlarged view of the portion of the structure that is encircled by the circle 6 in FIG. 3.
Figure 7:
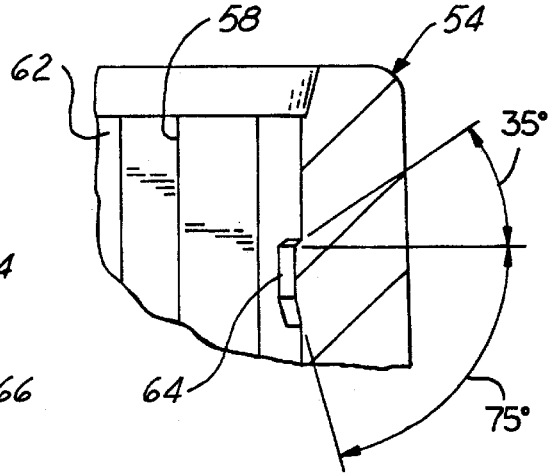
FIG. 7 is an enlarged fragmentary view of the portion of the structure encircled by the circle 7 in FIG. 4.

Referring more particularly to FIGS. 3–7, throttle lever detent arm 52 comprises a cylindrical hub 54 and a blade 56 in the form of a planar segment of a circle with sufficient circumferential angular extent to slightly more than encompass the angular range of travel of throttle valve 48. The inner periphery of the through-bore of hub 54 has the cross-sectional configuration shown in FIGS. 3–7 with diametrically opposed grooves 58 and 60 designed to allow some flexibility of hub 54 during assembly on the free end of shaft 46, and corresponding flat shoulders 62 that ride on corresponding flats (not shown) on the shaft free end thereby for keying detent arm 52 for rotational with shaft 46. As shown in FIG. 7, hub 54 also has a locking lug 64 with angled shoulders shown in FIG. 7 adapted for registration with a corresponding locking groove (not shown) in the free end of shaft 46 for releasibly retaining arm 52 axially on the free end of the shaft. Detent arm 52 is thus mounted on the throttle shaft free end for conjoint rotation with throttle valve 48 in a co-extensive angular travel path about the rotational axis 66 of shaft 46 (FIGS. 8–10).

As best seen in FIGS. 1, 3, 5 and 8–10, throttle lever detent arm 52 has an arcuate peripheral edge cam surface 68 having radial variations spaced circumferentially therealong and forming first detent means of the throttle control detent mechanism of this embodiment. Cam surface 68 is made up of a curved peripheral free end surface 70 of constant radius about rotational axis 66. The first radial variation comprises a notch 72 adjacent the conjunction of surface 70 with a radially extending side edge 74 of blade 56. The second radial variation comprises a notch 76 at the end of constant radius surface 70 opposite notch 72, notch 76 is spaced angularly about axis 66 the same number of degrees as the angular travel of throttle blade 48 between its fully open position (FIG. 10) and idle position (FIG. 9), e.g., 75°±3°.

Figure 4:
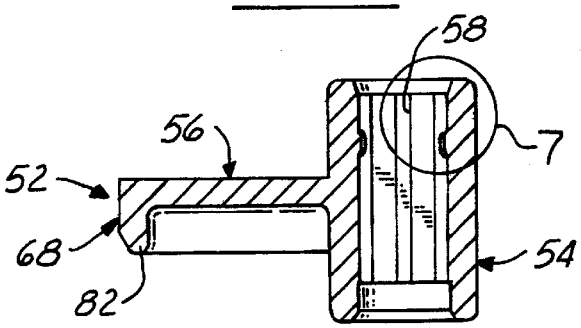
FIG. 4 is a cross-sectional view taken on the line 4—4 of FIG. 3.
Figure 5:
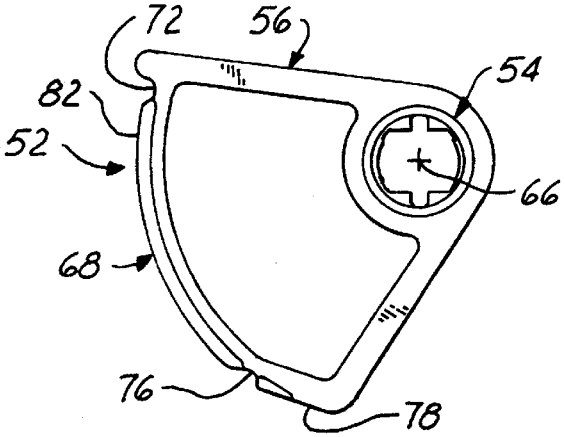
FIG. 5 is a side elevational view of the throttle lever detent arm of FIGS. 3 and 4 and showing the side opposite of that seen in FIG. 3.

The third radial variation in surface 68 is an inclined ramp chordal surface 78 that extends from adjacent notch 76, beginning with a radial dimension equal to that of surface 70, and then diminishing in radius to its junction with the other side edge 80 of blade 56. This ramp surface 78 is thus inclined radially inwardly or toward axis 66 a progressively increasing distance from the imaginary projection line 82 of constant radius surface 70 (shown in broken lines in FIG. 3). As best seen in FIGS. 4 and 5 preferably cam surface 68 is widened axially of detent arm 52 by molding a flange 82 integrally with the planar blade 56 of the arm. This flange track configuration provides an augmented bearing surface while reducing the overall mass of blade 56.

The first embodiment throttle control detent mechanism also includes second detent means in the form of a cam follower spring pin 90 mounted by force fit into a blind bore (not shown) formed in the side surface 50 of carburetor body 42. Due to its cantilever mounting on body 42 pin 90 has a slight resilience at its free end so that it can function as a semi-resilient cam follower spring pin 90 to develop biasing stress yieldable forcing the free end of pin 90 against cam surface 68. Pin 90 is thus located in a fixed location on body 42 position adjacent to the travel path of the arcuate cam surface 68 of arm 52 for continuous detent operable sliding engagement therewith. Preferably the O.D. of pin 90 is 1.20 mm. The radius of the notches 72 and 76 is preferably 0.60 mm to provide a precise fit of pin 90 into detent notches 72 and 76.

In accordance with another feature of the present invention, the radius dimension of cam surface 68 relative to rotational axis 66, and likewise the mounted spacing of pin 90 from axis 66 constitutes a predetermined distance greater than the diameter of throttle shaft 46 by a multiple of the shaft diameter dimension, such as on the order of generally three times the diameter of shaft 46 (i.e., 4.50 mm) in the examples shown in the first embodiment.

Also, it is to be understood that the first embodiment carburetor 40 is of the "split" type wherein a throttle control lever 92, shown only in FIG. 1, is mounted on an opposite free end (not shown) of throttle shaft 46 adjacent the side of carburetor body 42 opposite from surface 50. Throttle control lever 92 is thus affixed to throttle shaft 46 for rotating the same as lever 92 is manually swung through its operational angular range corresponding to the angular range of travel of butterfly blade 48 of the throttle valve.

In the operation of the first embodiment when control lever 92 is swung counterclockwise as viewed in FIG. 1 to one end limit of angular travel to position detent arm 52 as shown in FIGS. 1 and 8, throttle valve blade 48 likewise will be swung to its closed position shown in FIG. 8. In this predetermined throttle setting, pin 90 slidably bears against the ramp surface 78 and develops, due to its spring stress bias and the cooperative incline of ramp surface 78 relative to the projected radius 82 of surface 70, a slight counterclockwise torque on blade 56, thereby providing a constant biasing force maintaining valve 48 in fully closed position regardless of reasonable manufacturing tolerance variations in the relative location of blade 48, bore 44 and ramp surface 78.

More specifically, the circumferential length (in angular travel) of the inclined ramp surface 78 is made greater than the total expected tolerance stack up resulting from such variations.

When lever 92 is moved clockwise a predetermined few degrees from the position of FIG. 8 to thereby rotate detent arm 52 clockwise from the position of FIG. 8 to FIG. 9, pin 90 will yield by flexing resiliently as ramp surface 78 is moved along pin 90 until it registers with notch 76, whereupon the free end of pin 90 will snap into notch 76 to thereby set the second operable position of valve blade 48. As shown in FIG. 9 this is the idle position of plate 48 wherein the same is releasibly held slightly open. Lever 92 then may be released because the throttle valve will be reliably and precisely (within a tolerance of less than ±1 degree) maintained in this idle position by the detent mechanism as long as desired by the appliance operator.

When it is desired to move throttle valve blade 48 from idle to full open position, lever 92 is rotated farther in a clockwise direction to thereby rotate detent arm 52 from the FIG. 9 position to the FIG. 10 position. At the initiation of this movement pin 90 will be cam-forced out of notch 76 and then will slidably ride on constant radius surface 70 until notch 72 is registered with pin 90. Pin 90 is constructed and arranged so that it is always in contact with surface 68 when not engaging notches 72 or 76 or ramp 78. Notch 72 is angularly located to set the wide-open (W.O.T.) position of throttle valve blade 48 as shown in FIG. 10. It thus will be seen that the aforementioned first and second detent means of the throttle control mechanism of the invention may be constructed and oriented so as to be releasably engageable with one another to thereby accurately set, i.e., to precise and narrow position limits (less than ±1 degree),and reliably but yieldably hold detent arm 52 and hence throttle shaft 46 and associated throttle valve blade 48 in any one of a plurality of selected predetermined angular settings, e.g., closed, idle and wide-open (W.O.T.), and, if desired, an additional midpoint position.

When the throttle blade 48 is yieldably held in the closed valve position of FIG. 8, the carburetor will choke the engine of air and the engine will stop. When throttle 0 blade 48 is detent oriented and held in the aforementioned precisely established idle position of FIG. 9, the engine receives only enough fuel and air mixture from the carburetor to idle at a stable idle speed. At the wide-open throttle (W.O.T.) position of throttle blade 48 the detent mechanism provides another positive and accurate position stop to releasably hold blade 48 in the open position.

One of the primary features of the carburetor throttle control detent mechanism of the first embodiment as well as the remaining embodiments disclosed herein is the fact that engagement of the first and second detent means, regardless of their structural form, occurs in an arc of mutual engagement along a detent arm cam travel path having a radial dimension, centered on rotational axis 66, that is a multiple of the small diameter dimension of shaft 46, such as a multiple of three times the shaft diametrical dimension. This large radius of the travel path of arcuate cam control surface 68 of blade 56 thus allows the tolerance limits of the radial variations 72, 76 and 78 that are spaced circumferentially apart along surface 68 to be manufactured to the same manufacturing tolerance specifications that are otherwise normally employed in machining a detent ball seating groove in shaft 46 when providing the previously described prior art ball spring/ball detent mechanism. Yet in so doing, and without tightening up prior manufacturing tolerance specifications, the angular tolerance variation on the set positions of valve blade 48 as controlled by cam surface 68 is now approximately three times more precise, i.e. the tolerance limits for the detent controlled predetermined angular positions of blade 48 are now rendered at least three times tighter than otherwise would be possible when utilizing the prior control detent pockets provided in the surface of throttle shaft 46. For example, one typical ball and spring throttle detent control mechanism was specified with a tolerance range of ±3 degrees versus the aforementioned less than ±one degree capability of the invention. Hence manufacturing tolerances do not need to be tightened up in order to achieve a three-fold improvement in operational tolerances of the carburetor throttle control detent mechanism.

The invention thus provides a low cost throttle control detent mechanism that enables fine increment, positive position stops at predetermined valve blade settings, such as the W.O.T. (wide-open throttle), idle and closed valve positions illustrated herein. It therefore will now be seen that the detent mechanism of the invention enables controlling throttle clocking in very small increments throughout the angular range of throttle operation. This enables establishing an accurate idle position at only a very small (8 degrees±1 degree) angular spacing from the closed valve position. This is structurally achieved by moving by design the detent interengagement zone as far from the throttle shaft centerline 66 as possible consistent with the dimensional limits of the carburetor body, which in turn is utilized to provide the mounting platform for cam follower pin 90. The manufacture and assembly costs of detent arm 52 and cam follower pin 90 are less than those encountered with current ball and spring detents, particularly if such were done with precision manufacturing processes and equipment in attempting to achieve the same improved operational precision.

Second Embodiment Carburetor Throttle Control Detent Mechanism

Figure 11:
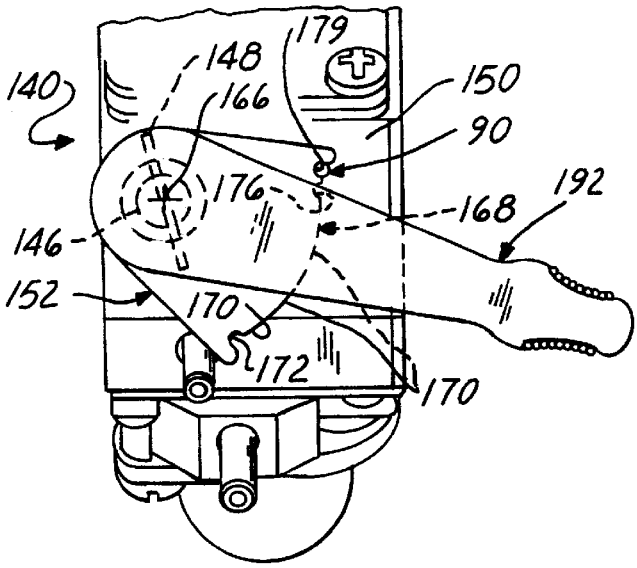
FIG. 11 is a side elevational view of a cubic type diaphragm carburetor provided with a second embodiment of a combined throttle lever and throttle lever detent arm mechanism also constructed in accordance with the invention.
Figure 12:
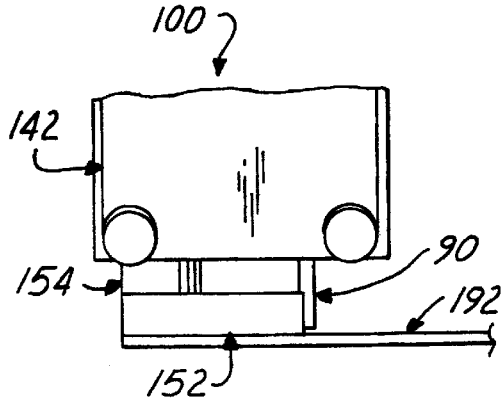
FIG. 12 is a fragmentary top plan view of the carburetor in FIG. 11.
Figure 13:
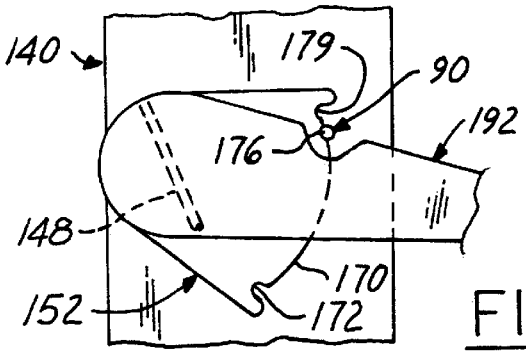
FIGS. 13 and 14 are respectively fragmentary simplified semi-diagrammatic side elevational views of the carburetor of FIGS. 11 and 12 respectively showing the throttle valve set to idle position (FIG. 13) and to wide-open position (W.O.T.), (FIG. 14).
Figure 14:
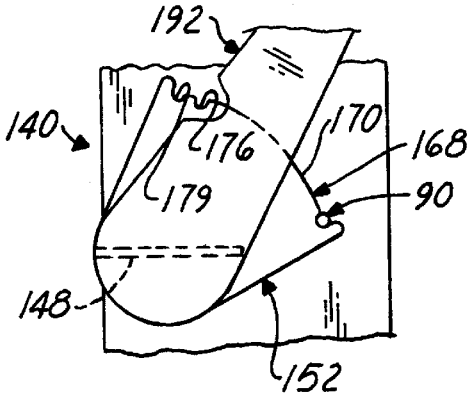

The second embodiment carburetor throttle control detent mechanism of the invention is illustrated in FIGS. 11–14 wherein elements alike in structure and/or function to those of the first embodiment are given a like reference numeral raised by a factor of 100. Carburetor 140 of the second embodiment is similar to carburetor 42 but is not of the "split" type. Rather the manually manipulated throttle lever 192 and the associated throttle lever detent arm 152 are both mounted on the same side of the carburetor, preferably using a mounting hub construction 154 similar to hub 54. Lever 192 and throttle lever detent arm 152 may be made as two separate components bonded together, or may be a one piece part made integral with one another by molding. ("Integral" as used herein means molded or cast as a one piece, unitary part). Throttle lever detent arm 152 differs from arm 52 only with respect to the formation of the detent for holding throttle valve 148 in closed position (FIG. 11). Instead of having a biasing ramp 78, a notch 179 is provided similar to notch 176 but located at the opposite end limit of detent cam control surface 168 so as to be registered with and held by pin 190 when lever 192 is swung to one end limit of its swing travel corresponding to valve blade 148 reaching fully closed position (FIG. 11).

Pin 190 that serves as the first detent means of carburetor construction 140 again maybe made of spring steel material or, alternatively, made of a suitable semi-resilient plastic material such as that sold under the trademark Delrin®.

It will thus be seen that the mode of operation of the throttle control detent system of the second embodiment carburetor 140 is similar to that of carburetor 40 described previously except that detent notch 179 does not develop a valve-closing torque on detent arm 152. Again it will be seen that the radius dimension of detent cam control surface 168 is approximately three times the diametrical dimension of throttle shaft 146. Hence, even manufacturing the detent holding radial variations 172, 176 and 179 in control surface 168 to the same manufacturing tolerance specifications as those previously provided for machining detent pockets in the throttle shaft for the prior art ball and spring detent mechanism will automatically result in reducing the operational tolerances achieved in the angular detent settings of throttle valve blade 148 to at least one-third of those achieved with the ball coil spring and throttle shaft pocket detent system of the prior art.

Moreover, in the second embodiment, as in all the embodiments of the invention, this much more precise detent setting of the throttle valve is achieved while at the same time obtaining a detent holding moment arm that is orders of magnitude greater than the prior ball detent throttle shaft cavity moment arm. Hence the cam follower pin 90, 190 can exert braking torque on detent arm 52, 152 that is 5 or 6 times that of the ball spring detent system for the same amount of applied detent spring force. This in turn enables the spring stress built into the detent system, either in the cam follower pin 90, 190 or equivalent cam followers and/or into the resilience of the detent arm cam track surface, to be significantly reduced as compared to coil spring forces without sacrificing adequate holding power of the detent system.

Third Embodiment Carburetor Throttle Control Detent Mechanism

Figure 15:
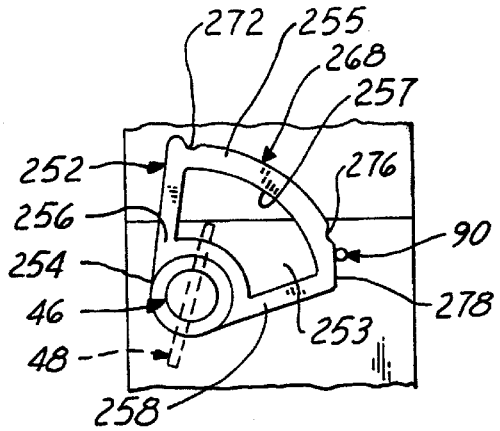
FIG. 15 is a simplified semi-diagrammatic side elevational view of a third embodiment throttle control detent mechanism of the invention and illustrating a throttle closed position.

FIG. 15 illustrates a third embodiment of a throttle lever detent arm 252 of the invention. Detent arm 252 is identical to detent arm 52 except for having a large mass of material of the arm removed to leave a relatively wide arcuate slot 253 formed in blade 256 of the arm located radially between hub 254 and the peripheral edge cam control surface 268 of arm 252. Molding or machining arm 252 with slot 253 is advantageous in reducing the weight and material cost of the arm. Slot 253 also renders it possible to design-control radial deflection of the web portion 255 remaining between cam edge surface 268 and the arcuate radially outer edge 257 of slot 253. Slot 253 thus adds flexibility to the outer edge of arm 252 so that the same can provide spring stress for the detent mechanism, either alone or in combination with the spring stress provided by the material of pin 90. The contour of outer slot edge 257 thus may be varied to enhance the desired flexibility and resiliency of edge 268 as needed or desired.

Figure 16:
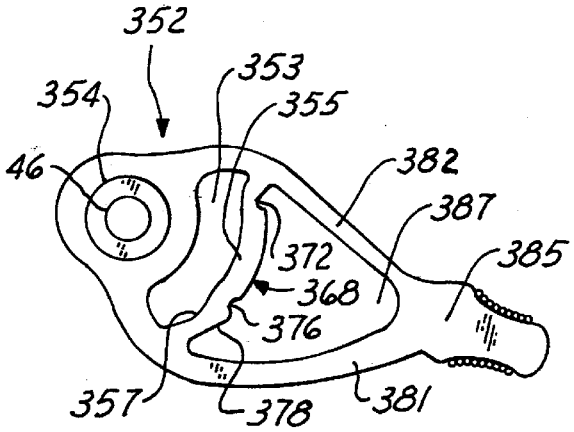
FIG. 16 is a simplified side elevational view of a throttle lever detent arm and throttle control arm combined into a unitary part as a fourth embodiment of the invention.

Fourth Embodiment Carburetor Throttle Control Detent Mechanism FIG. 16 illustrates a fourth embodiment of a combined one piece throttle lever and throttle lever detent arm 352 which may be substituted for detent arm 152 and control arm 192 of FIGS. 11–14. Again those elements alike in structure and/or function to those of the first embodiment of FIGS. 1–10 are given like reference numerals raised by a factor of 300. Control lever detent arm 352 has a cam control web 355 similar to web 255 and formed between a cutout 353 to reduce weight and add resilience to web 355 for developing detent spring stress forces. Detent arm 352 has two extension lever arms 381 and 382 integrally joined at one end to the respective opposite ends of web 355 and extending therefrom convergently radially away from hub 354. Arms 381 and 382 terminate in a finger tab portion 385 and define therebetween another void or cutout portion 387 in lever 352. Preferably lever 352 is molded in one piece from suitable plastic material, including hub portion 354. Except for hub portion 354 the remainder of arm 352 may be of uniform thickness and with parallel flat sides. Again the contour of a radially outer edge 357 of slot 353 may be contoured as desired to add or subtract resilience to various peripheral zones of the web 355 to enhance the spring forces and detent holding function of this throttle arm detent system.

Figure 2:
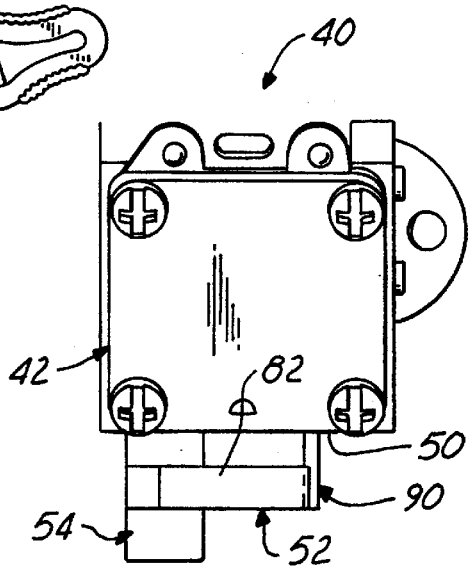
Figure 17:
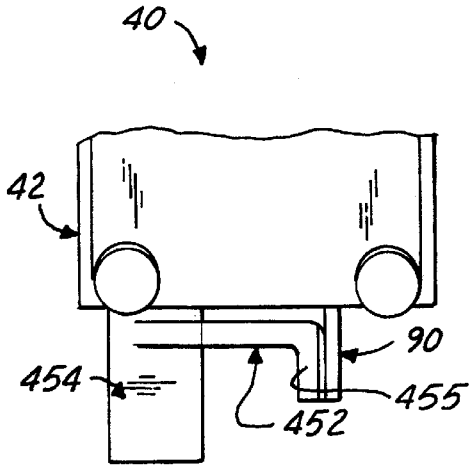
FIGS. 17 and 18 are respectively fragmentary top plan and side elevational views of a fifth embodiment throttle control detent mechanism of the invention.
Figure 18:
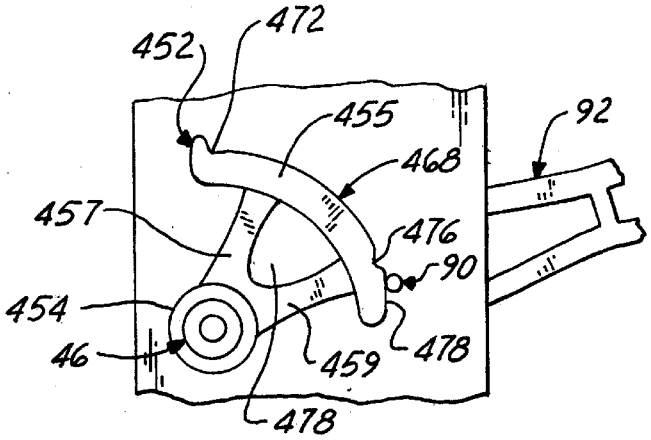

Fifth Embodiment Carburetor Throttle Control Detent Mechanism FIGS. 17 and 18 illustrate a fifth embodiment carburetor throttle control detent mechanism of the invention utilizing the "split" carburetor 40 of the first embodiment of FIGS. 1 and 2 as well as the cam follower pin 90 thereof. However the throttle lever detent arm 452 of the fifth embodiment differs from the arm 52 of the first embodiment in having only two angularly spaced and radially divergent support arms 457 and 459 extending radially from an integral junction with mounting hub 454 to an integral junction at their radially outermost ends with a cam control track member 455. Track 455 has on its outer periphery a cam control surface 468 configured with the circumferentially spaced radial variations that provide the aforementioned second detent means in the form of ramp 478, idle notch 476 and W.O.T. notch 472. It thus will be seen that the configuration and construction of the throttle lever detent arm 452 utilizes a minimum of material while operating in the manner of the first embodiment throttle control detent system.

Sixth Embodiment Carburetor Throttle Control Detent Mechanism

FIGS. 19–22 illustrate a sixth embodiment carburetor throttle control detent mechanism or system of the invention employed in a split-type carburetor 540, similar to carburetor 40, except carburetor 540 also has a conventional choke valve shaft 510 in addition to the throttle valve shaft 546 of the previous embodiments. Again, like elements are given like reference numerals raised by a factor of 500 to designate like structure and/or like function to the previously described first embodiment.

Figure 21:
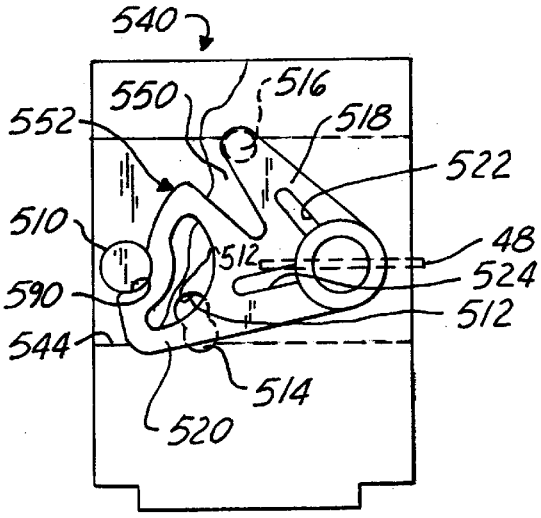
Figure 22:
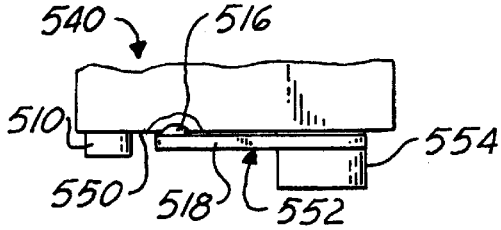
FIG. 22 is fragmentary top plan view of the sixth embodiment throttle control mechanism of FIGS. 19–21.

In the sixth embodiment the aforementioned first detent means of the detent control system that is provided on the body side surface 550 of carburetor 540 includes the protruding free end of a choke shaft 510 and it is utilized to serve as a W.O.T. throttle valve position stop (FIG. 21). Moreover, instead of a cam follower pin 90, an idle-stop hemispherical concavity or pocket 512 is formed in the side surface 550 of the carburetor body 542, and an adjacent throttle-closed hemispherical concavity or pocket 514 is likewise formed in body side surface 550, concavities 512 and 514 serve as the additional first detent means.

The second detent means provided on the throttle lever detent arm 552 comprise a wide-open throttle position notch 590 formed on the outer peripheral control cam surface 568 of detent arm portion 520 of arm 552, and a laterally extending protuberance or button 516 provided on the carburetor side of and adjacent a distal end of a spring arm portion 518 of detent arm 552. Arm portion 518 is tapered to narrow at its distal end and is integrally joined at its wider end to the hub 554 of detent arm 552. Spring arm 518 can also be used to axially bias the throttle shaft when needed.

Detent arm portion 520 is angularly divergent from arm portion 518 and spaced therefrom by a tapered slot defined by a side edge 522 of flex arm portion 518 and a side edge 524 of arm portion 520. A weight reducing and resilience enhancing slot 553 is provided in arm portion 520. The radially outer edge 557 of slot 553 is configured to enhance spring resilience of the engagement of edge concavity 590 in functioning as a yieldable detent in cooperation with choke shaft 510.

Figure 19:
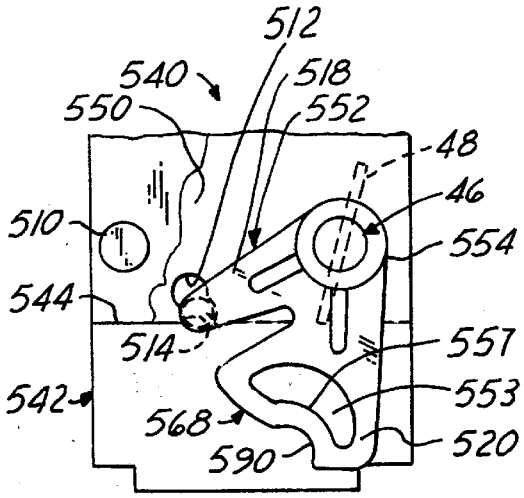
FIGS. 19, 20 and 21 are simplified semi-diagrammatic views of a sixth embodiment throttle control mechanism and associated carburetor respectively illustrating the same in a throttle valve closed position (FIG. 19), idle position (FIG. 20) and a wide-opened throttle (W.O.T.)
Figure 20:
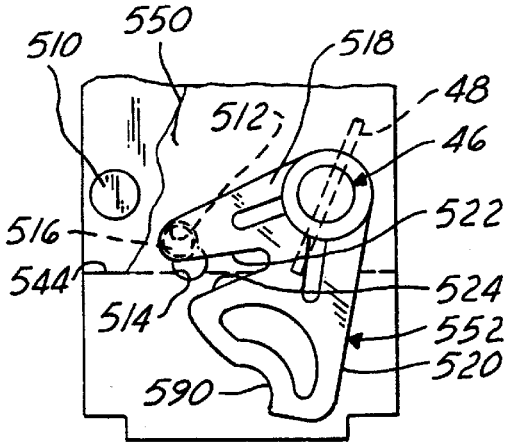

In the operation of the sixth embodiment carburetor construction 540, it will be seen that when detent arm 552 is swung by rotation of throttle shaft 46 to the throttle closed position shown in FIG. 19, button 516 will drop into the registering pocket concavity 514, thereby yieldably restraining detent arm 552 and hence throttle valve blade 48 in the throttle-closed position shown in FIG. 19. When throttle shaft 46 is rotated by an operator swinging throttle control lever 92 clockwise as viewed in FIGS. 19–21 out of the closed position of FIG. 19, the torque exerted on detent arm 552 will cause button 516 to be cammed out of concavity 514, thereby flexing arm 518 sideways until button 516 registers with the idle position concavity 512. Button 516 thereupon will be forced to drop into concavity 512 by the resilient bending stress of spring arm 518, and valve blade 48 thereby will then be held in the idle position of FIG. 20 by detent arm 552. When it is desired to rotate throttle valve 48 to wide-opened throttle (W.O.T.) position shown in FIG. 21, further clockwise rotation of lever arm 92 forces button 516 to be cammed out of concavity 512 50 that it then slidably rides against the side surface of 550 of carburetor body 542. During this transition rotation of detent arm 552: cam surface 568 of arm portion 520 swings into sliding engagement with the surface of choke shaft 510. Cam surface 568 then resiliently yields until notch 590 registers with shaft 510 to thereby yieldably restrain detent arm 552 in the position shown in FIG. 21 and thus setting throttle valve blade 48 in W.O.T. position.

The foregoing sixth embodiment construction thus provides a low cost method of retaining the throttle at the W.O.T. position in a carburetor having a choke shaft by utilizing the same as part of the detent system. Again, due to the increased distance of detent notch 590 and button 516 radially outwardly from the axis of throttle shaft 46, throttle clocking is precisely controlled in very small angular increments throughout the angular range of throttle operation without requiring precision manufacturing tolerance. The force multiplying advantage of an increased moment arm in the detent system is also realized in this embodiment. The detent pockets 512 and 514 that are machined or cast into the side face 550 of carburetor body 542 are inexpensive to manufacture and not subject to break off and damage. Preferably the detent arm 552 is made of a semi-resilient and durable plastic material such as Delrin® plastic material. The idle speed setting can be readily changed by changing the location of the detent machining for pocket 512 in the carburetor casting body. The detent spring retaining force can be varied by design of the configuration of spring arm 518, both in outline and thickness, as desired to meet the desired conditions of each given design. Preferably weight reduction, material saving and flexibility slots 522 and 524 are provided in a radially extending direction centrally of arms 518 and 520 respectively.

Seventh Embodiment Carburetor Throttle Control Detent Mechanism

Figure 24:
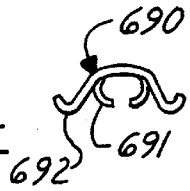
FIG. 24 is an end elevational view of the cam follower part of FIG. 23.
Figure 23:
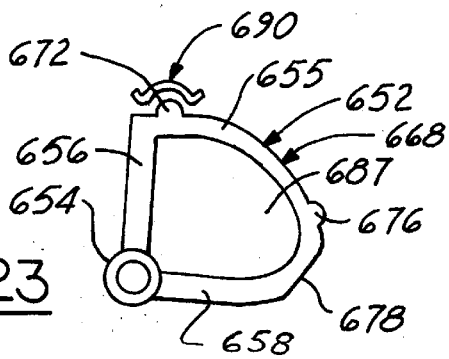
FIG. 23 is a semi-schematic side elevational view of a seventh embodiment throttle control lever detent mechanism of the invention.
Figure 25:
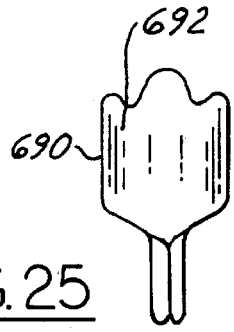
FIG. 25 is side elevational view of the cam follower of FIG. 24.

FIGS. 23, 24 and 25 illustrates components of a seventh embodiment throttle lever and detent arm and associated cam follower pin projection that represent in some respects a reversal of the radially varied configuration of the detent system of the first embodiment of FIGS. 1–10. A throttle lever detent arm 652 is molded integrally with a mounting hub 654 constructed in the manner of hub 54. Detent arm 652 has a large central void 687 defined by two angularly spaced and radially extending arms 656 and 658 similar to arms 256 and 258 of the embodiment of FIG. 15. An outer arcuate web 655 is connected at its circumferentially opposite ends to arms 656 and 658 respectively. The peripheral cam control surface 668, instead of having concavities 272 and 276 as in arm 252 of FIG. 15, has radial protuberances or knobs 672 and 676 located to define the W.O.T. and throttle idle positions respectively. An inclined ramp surface 678 is provided along control surface 668 that functions in the manner of ramp 278 or ramp 78 of arms 252 or 52 respectively.

The first detent means on the body of the carburetor comprise a flexible cam follower 690 (FIGS. 23, 24 and 25) having a shank portion which may be in the form of a roll pin portion 691 seen in FIGS. 24 and 25 if made as a stamping from sheet metal. The blade portion 692 of follower 690 is in the form of a paddle with curved opposite side edges to facilitate being flexed and cammed by travel therepast of the protuberances 672 and 676 when sequentially registering with cam follower 690. Alternatively, cam follower 690 may be molded from resilient plastic material with shank portion 691 being a solid cylindrical stem portion of the paddle portion 692. When ramp portion 678 of cam contour edge 668 engages cam follower 690, one side edge of blade portion 692 of cam follower 690 will bear against ramp 678 and thereby develop the biasing torque to maintain the throttle valve in closed position.

We claim:

1. In a carburetor having a body with an air-fuel mixture passageway and a rotatable throttle valve in said passageway mounted for rotation on and with a throttle shaft journaled for rotation on a rotational axis in said body and having a free end protruding exteriorly of said body from an exterior side surface of said body, said throttle shaft having a given diameter of relatively small dimension, a throttle lever detent arm mounted on said throttle shaft free end for rotation therewith in an angular travel path about said rotational axis adjacent said exterior side surface of said body, a first detent on said body side surface located in fixed position thereon adjacent the travel path of said detent arm and spaced radially away from said axis a predetermined distance greater than the diameter of said throttle shaft, said detent arm having a second detent thereon likewise generally spaced said predetermined distance radially away from said rotational axis and constructed and oriented so as to be releasably engageable with said first detent for thereby yieldably holding said arm and hence said throttle shaft and associated throttle valve in any one of a plurality of selected angular settings.

2. The carburetor of claim 1 wherein said throttle lever detent arm comprises a planar segment of a circle with an arcuate cam surface having radial variations therein spaced circumferentially therealong forming said first detent, and said second detent comprises a cam follower fixedly supported on said body side surface and yieldably engaging and tracking on said segment cam surface and registerable with said radial variations for releasably holding said segment in any one of said plurality of settings as determined by location of said radial surface variations circumferentially along said segment cam surface.

3. The carburetor of claim 2 wherein said segment cam surface comprises an arcuate peripheral free edge and said segment is constructed to have void means located adjacent said segment free edge to thereby add resilience to said free edge engagement with said cam follower tracking therealong and also to thereby reduce the mass of said segment.

4. The carburetor of claim 2 wherein one of said radial edge variations of said segment peripheral edge comprises a concavity, and said carburetor has a rotatable choke shaft with a choke valve mounted on said choke shaft for rotation therewith, said choke shaft having a free end protruding from said carburetor body side surface adjacent the travel path of said segment free edge and oriented to function as one of said second detents by yieldable registry engagement of said segment edge concavity therewith.

5. The carburetor of claim 2 wherein said radial variations of said cam surface comprise indentations spaced circumferentially therealong in predetermined locations corresponding to said plurality of selected angular settings of said throttle valve, and wherein said cam follower comprises a pin cantilever mounted in said body side surface and yieldably registerable with said indentations when the same are individually brought into angular alignment with said pin in response to rotation of said throttle shaft.

6. The carburetor of claim 5 wherein one of said indentations is designed to correspond to the closed position of said throttle valve and comprises an inclined surface oriented such that engagement with said cam follower pin develops a torque on said detent arm segment in a direction tending to further close said throttle valve to thereby maintain a closing bias on said throttle valve during such engagement.

7. The carburetor of claim 1 wherein said carburetor also has a throttle lever constructed for manual manipulation for swinging through an operational range corresponding to the angular operation al range of said throttle valve and operable to impart operator torque forces on said throttle shaft for rotating the same, and wherein said throttle lever detent arm is integrated with said throttle lever and fixed thereto for co-rotation therewith.

8. The carburetor of claim 7 wherein said throttle lever and throttle lever detent arm are integrated into a unitary part and are co-planar with one another.

9. The carburetor of the claim 8 wherein said throttle lever detent arm comprises a planar segment of a circle with an arcuate cam surface having radial variations therein spaced circumferentially therealong forming said first detent, and said second detent comprises a cam follower fixedly supported on said body side surface and yieldably engaging and tracking on said segment cam surface and registerable with said radial variations for releasably holding said segment in any one of said plurality of settings as determined by location of said radial surface variations circumferentially along said segment cam surface, and wherein said segment cam surface comprises an arcuate peripheral free edge and said segment is constructed to have void means located adjacent said segment free edge to thereby add resilience to said free edge engagement with said cam follower tracking therealong and also to thereby reduce the mass of said segment.

10. The carburetor of claim 9 wherein said lever portion of said unitary part has additional void means radially outwardly of said segment free edge for reducing the overall mass of the part.

11. The carburetor of claim 1 wherein said first detent on said carburetor comprises at least one concavity formed in said body side surface and said second detent comprises a lateral projection on said throttle lever detent arm oriented to ride on said body side surface and operably snap into said concavity upon registry therewith by spring bias developed in said throttle lever detent arm.

12. The carburetor of claim 11 wherein said second detent further includes a peripheral edge of said detent arm having a concavity therein in the path of travel of said arm, and wherein said carburetor has a rotatable choke shaft with a choke valve mounted thereon for rotation therewith, said choke shaft having a free end protruding from said carburetor body side surface adjacent to the travel path of said segment free edge and oriented to function as one of said second detents by yieldable registry engagement of said segment edge concavity therewith during the rotation of said throttle shaft.

13. The carburetor of claim 2 wherein said radial variations in said arcuate cam surface of said detent arm comprise radial protrusions spaced circumferentially thereon corresponding to the selected angular settings of said throttle valve, and said cam follower comprises a semi-resilient paddle member having a shallow "W" configuration in radial cross section adapted to slidably bear on said cam surface and to be cammed over and then individually registered with said radial protrusions, said cam follower having a stem portion received in a mounting opening in the side surface of said carburetor body for cantilever support therefrom of said cam follower.

14. The carburetor of claim 1 wherein said throttle lever detent arm comprises a pair of angularly spaced apart, radially extending support legs joined at one end to a hub mounted on said throttle shaft free end, and wherein the radially outermost distal ends of said support legs carry an arcuate cam track member having said arcuate cam surface thereon and with said radial variations formed therein to provide such first detent.

* * * * *

UNITED STATES PATENT AND TRADEMARK OFFICE

CERTIFICATE OF CORRECTION

PATENT NO. : 6,561,496 B2
DATED : May 13, 2003
INVENTOR(S) : Gary U. Gliniecki et al.

It is certified that error appears in the above-identified patent and that said Letters Patent is hereby corrected as shown below:

Column 10,
Lines 21-22, please indicate "Fourth Embodiment Carburetor Throttle Control Detent Mechanism" as the title of the next section.
Lines 46-47, please indicate "Fifth Embodiment Carburetor Throttle Control Detent Mechanism" as the title of the next section."

Column 11,
Line 63, after "552" delete the colon (:) and insert a comma (,).

Column 13,
Line 66, delete "operation al" and insert -- operational --.

Signed and Sealed this

Eleventh Day of November, 2003

JAMES E. ROGAN
*Director of the United States Patent and Trademark Office*